US006526611B2

(12) United States Patent
Flynn et al.

(10) Patent No.: US 6,526,611 B2
(45) Date of Patent: Mar. 4, 2003

(54) AMBULANCE STRETCHER WITH IMPROVED HEIGHT ADJUSTMENT FEATURE

(75) Inventors: Jeffrey T. Flynn, Cincinnati, OH (US); Christopher S. High, Xenia, OH (US); Jerry L. Taylor, Greenfield, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 10/037,930

(22) Filed: Jan. 4, 2002

(65) Prior Publication Data

US 2002/0056162 A1 May 16, 2002

Related U.S. Application Data

(63) Continuation of application No. 09/533,137, filed on Mar. 23, 2000.

(51) Int. Cl.[7] ..... A61G 1/02; A61G 7/015

(52) U.S. Cl. ..... 5/611; 5/86.1; 5/618; 296/20

(58) Field of Search ..... 5/11, 81.1 R, 86.1, 5/424, 425, 610, 611, 613, 618, 617, 625, 627, 658, 723; 16/35 R; 296/20

(56) References Cited

U.S. PATENT DOCUMENTS

| | | | | |
|---|---|---|---|---|
| 2,096,229 | A | 10/1937 | Dudley | |
| 2,262,433 | A | 11/1941 | Uecker et al. | |
| 2,958,873 | A | 11/1960 | Ferneau | |
| 3,493,085 | A | 2/1970 | Libhart | |
| 3,644,944 | A | 2/1972 | Bourgraf et al. | |
| 3,980,334 | A | 9/1976 | Ferneau et al. | |
| 4,097,941 | A | 7/1978 | Merkel | |
| 4,192,541 | A | 3/1980 | Ferneau | |
| 4,767,148 | A | 8/1988 | Ferneau et al. | |
| 5,271,113 | A | 12/1993 | White | |
| 5,365,622 | A | 11/1994 | Schirmer | |
| 5,432,966 | A | 7/1995 | Berta et al. | |
| 5,435,027 | A | 7/1995 | Bourgraf et al. | |
| 5,438,723 | A | 8/1995 | Carroll | |
| 5,495,914 | A | 3/1996 | DiMucci et al. | |
| 5,509,159 | A | 4/1996 | Du-Bois | |
| 5,537,700 | A | 7/1996 | Way et al. | |
| 5,575,026 | A | 11/1996 | Way et al. | |
| 5,669,466 | A | 9/1997 | Cheng | |
| D384,834 | S | 10/1997 | Midorikawa et al. | |
| 5,697,471 | A | 12/1997 | DiMucci et al. | |
| 5,740,884 | A | 4/1998 | DiMucci et al. | |
| 5,862,551 | A | 1/1999 | Oguma et al. | |
| 5,887,302 | A | 3/1999 | DiMucci et al. | |
| 5,983,425 | A | 11/1999 | DiMucci et al. | |
| 5,987,673 | A | 11/1999 | Smith | |
| 6,014,783 | A | 1/2000 | Collier et al. | |
| 6,125,485 | A | 10/2000 | Way et al. | |
| 6,219,881 | B1 | 4/2001 | Wen | |
| 6,276,010 | B1 | 8/2001 | Way et al. | |
| 6,389,623 | B1 * | 5/2002 | Flynn et al. | 5/611 |
| 2002/0056162 | A1 * | 5/2002 | Flynn et al. | 5/611 |

FOREIGN PATENT DOCUMENTS

| | | |
|---|---|---|
| BE | 555994 | 4/1957 |

* cited by examiner

*Primary Examiner*—Robert G. Santos
(74) *Attorney, Agent, or Firm*—Killworth, Gottman, Hagan & Schaeff, L.L.P.

(57) ABSTRACT

A stretcher comprised of a roller base, a scissor-type lift frame having a lower end rotatably connected to the base, a tubular undercarriage rotatably and slidably connected to an upper end of the frame, a foldable rigid support positionable over the undercarriage, a soft, foldable cushion positionable over the support and connected thereto to prevent disassociation therefrom, and first and second side-arm supports rotatably connected to the undercarriage. The undercarriage includes first and second longitudinal frame members and first and second movable end extensions. Internal to each of the longitudinal frame members is a releasably locking mechanism to lock the stretcher at a predetermined height. The internal locking mechanism is releasable allowing the stretcher to be vertically adjusted by either one or two thumb triggers, located at one of the movable end extensions.

20 Claims, 9 Drawing Sheets

AMBULANCE STRETCHER WITH IMPROVED HEIGHT ADJUSTMENT FEATURE

CROSS-REFERENCE TO RELATED APPLICATIONS

This application is a continuation of U.S. patent application Ser. No. 09/533,137, filed Mar. 23, 2000.

FIELD OF THE INVENTION

The present invention relates to an emergency stretcher for emergency vehicles, and more particularly, to an emergency stretcher with an improved height adjustment feature.

BACKGROUND OF THE INVENTION

Typically, an emergency stretcher for emergency vehicles includes a patient litter vertically movable by an X-frame undercarriage that is supported by a wheel base. Examples of such prior art stretchers are disclosed in U.S. Pat. Nos. 4,097,941, 4,192,541, 4,767,148, 5,537,700, and 5,575,026. Although the prior art stretchers have been generally adequate for their intended purposes, they have not been satisfactory in all aspects.

For example, some of these prior art X-frame undercarriages include a releasable locking mechanism having springs, saw toothed members, levers, and horizontal cross members that are external and exposed underneath the patient litter. In some emergency situations, blood soaking through or around the litter padding may contaminate the exposed parts of the undercarriage making the cleaning of the stretcher more difficult. Additionally, some of these prior art stretchers include crossbars on the X-frame undercarriages for added support strength, but having these crossbars adds further to the cleaning problem.

Furthermore, when a number of ambulances respond to an emergency situation the stretchers from the various unit are often not interchangeable due to the incompatible fastening systems on the cots with some of the responding ambulances. This is a problem in the situations where a unit is the first to respond to a scene to retrieve patients but is block-in by later arriving emergency vehicles. If the securing attachment of the stretcher of the first responding ambulance is incompatible with the securing system of an unblocked ambulance, then the patient will either need to be move to a compatible stretcher or wait until the carrying ambulance is freed from the traffic of emergency vehicles.

Accordingly, there is a need for an emergency stretcher with an improved undercarriage that does not have an exposed releasable locking mechanism for vertical height adjustment, does not require crossbars, and has a fastening arrangement that makes it universal with a majority of the cot fastening systems carried on emergency vehicles.

BRIEF SUMMARY OF THE INVENTION

This need is met by the present invention wherein a stretcher comprises, generally, a roller base, a scissor-type lift frame having a lower end rotatably connected to the base, a tubular undercarriage rotatably and slidably connected to an upper end of the frame, a foldable patient support positionable over the undercarriage, a soft, foldable cushion positionable over the patient support and connected thereto to prevent disassociation therefrom, and first and second side-arm supports rotatably connected to the undercarriage.

The wheeled base is rectangular and supports caster wheels at its corners and includes an attachment which permit the stretcher to be secured within conventional ambulances. The lift frame includes a pair of fixed-length leg members and a pair of telescoping variable-length leg members, both of which are rotatably connected to the wheeled base. One of each pair of the leg members is connected to one another at their respective mid-sections by a joint, and is rotatable with respect to one another along an axis of the joint, which is offset from the leg member's central axes. This allows the leg members to be aligned with one another when the frame is fully collapsed. The variable-length leg members may include gas-charged cylinders therein to assist in extending the lift frame and in raising the stretcher thereby.

The undercarriage includes first and second longitudinal frame members and first and second movable end extensions. The upper ends of the fixed-length members of the lift frame are rotatably connected to the undercarriage, whereas the upper ends of the variable-length members of the lift frame are slidably, as well as rotatably, connected to the undercarriage. A securing device is provided internally to the longitudinal frame members, wherein securing bars are slidably positioned therein. Each securing bar has one or more recesses spaced there along which is engaged by one of a pair of latches to lock the stretcher at a predetermined height. Each latch is disengaged from the recess of the slidable securing bar by either one or two thumb triggers, located at one of the movable end extensions. Both movable end extensions of the stretcher can be rotatably adjusted from a planar position, to a beveled position and to a dropped position by an associated end release lever.

The patient support and the cushion affixed thereto are also adjustable in thirds and the rigid support includes a mechanical or gas-charged cylinder to assist lifting. Preferably, these components have waffle-type engagement ends to permit articulatable attachment of the three pieces. The side-arm supports rotate about an axis which is offset from the axis of the longitudinal frame members, thereby providing 180 degrees rotational freedom of the side-arm supports from a vertically-up position to a vertically-down position.

In accordance with one embodiment of the present invention, provided is an emergency stretcher, comprising a vertically adjustable wheeled undercarriage having a tubular frame member providing a cavity; an articulatable patient support mount to the undercarriage; and a securing device accommodated within the cavity of the tubular frame member to releasably arrest vertical movement of the patient support by the undercarriage.

In accordance with another embodiment of the present invention, provided is an emergency stretcher, comprising a vertically adjustable wheeled undercarriage having opposed first and second longitudinal frame members each having a proximate end and a distal end, the undercarriage includes a first movable end extension rotatably mounted at the proximate end of each the longitudinal support members, and a second movable end extension rotatably mounted at the distal end of each the longitudinal support members; an articulatable patient support provided on the undercarriage; and a securing device mounted to the undercarriage to releasably arrest vertical movement of the patient support by the undercarriage.

In accordance with another embodiment of the present invention, provided is an emergency stretcher, comprising a vertically adjustable wheeled undercarriage having opposed first and second longitudinal frame members each having a proximate end, the undercarriage includes a first movable end extension rotatably mounted at the proximate end of each the longitudinal support members, the first movable end extension being positionable in at least two positions; an articulatable patient support provided on the undercarriage; a securing device mounted to the undercarriage to releasably arrest vertical movement of the patient support by the undercarriage; and at least one release flipper mounted to the first movable end extension and operational connected to the securing device such that depressing the at least one release flippers will release the securing device in the at least two positions, thereby permitting the vertical movement of the patient support by the undercarriage.

Other objects of the present invention will be apparent in light of the description of the invention embodied herein.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION

Figure 1:
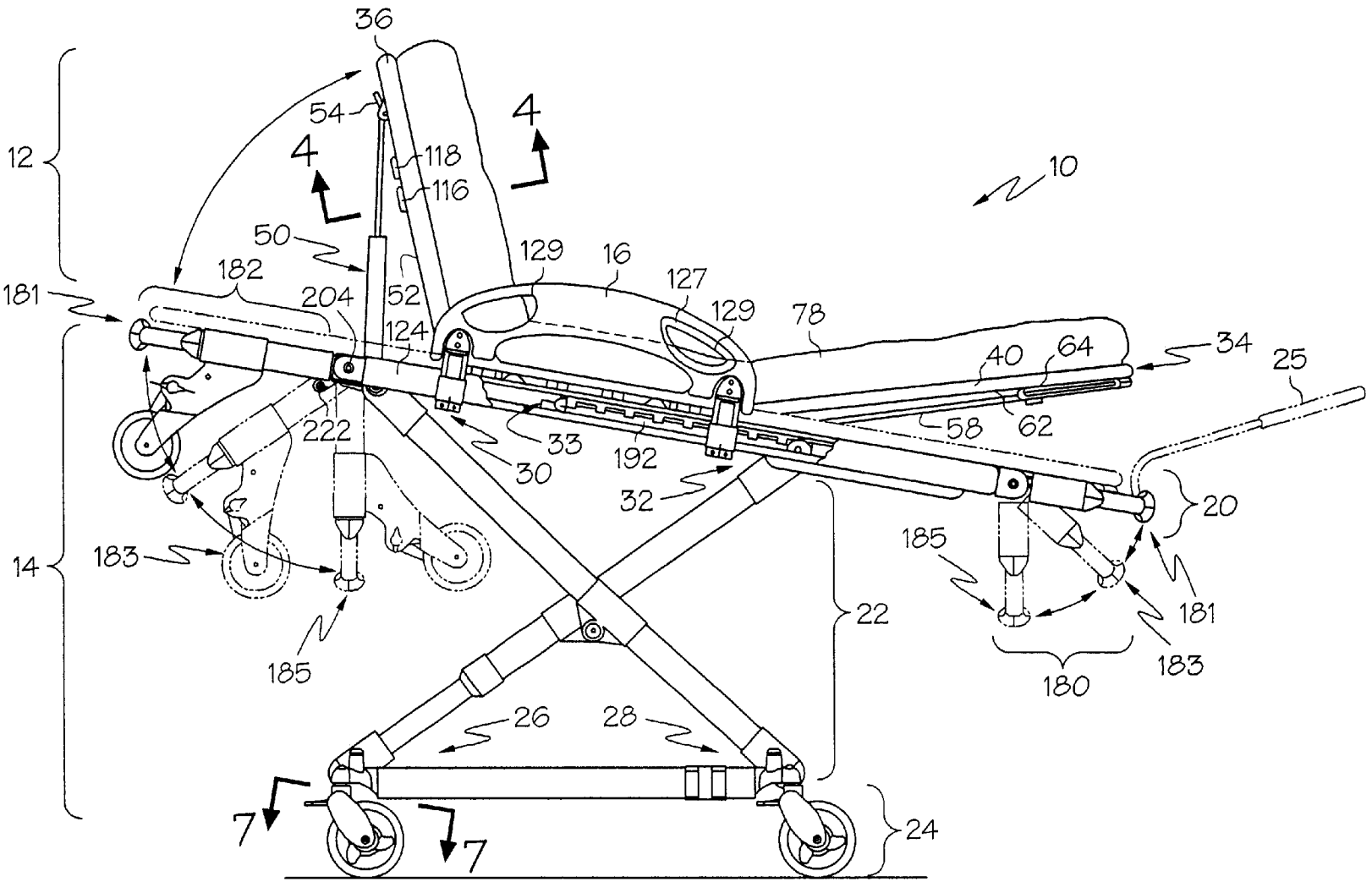
FIG. 1 is a side view of an emergency stretcher which embodies the present invention, with a longitudinal frame member illustrated by a partial sectional view showing an internal securing device of the present invention.
Figure 2:
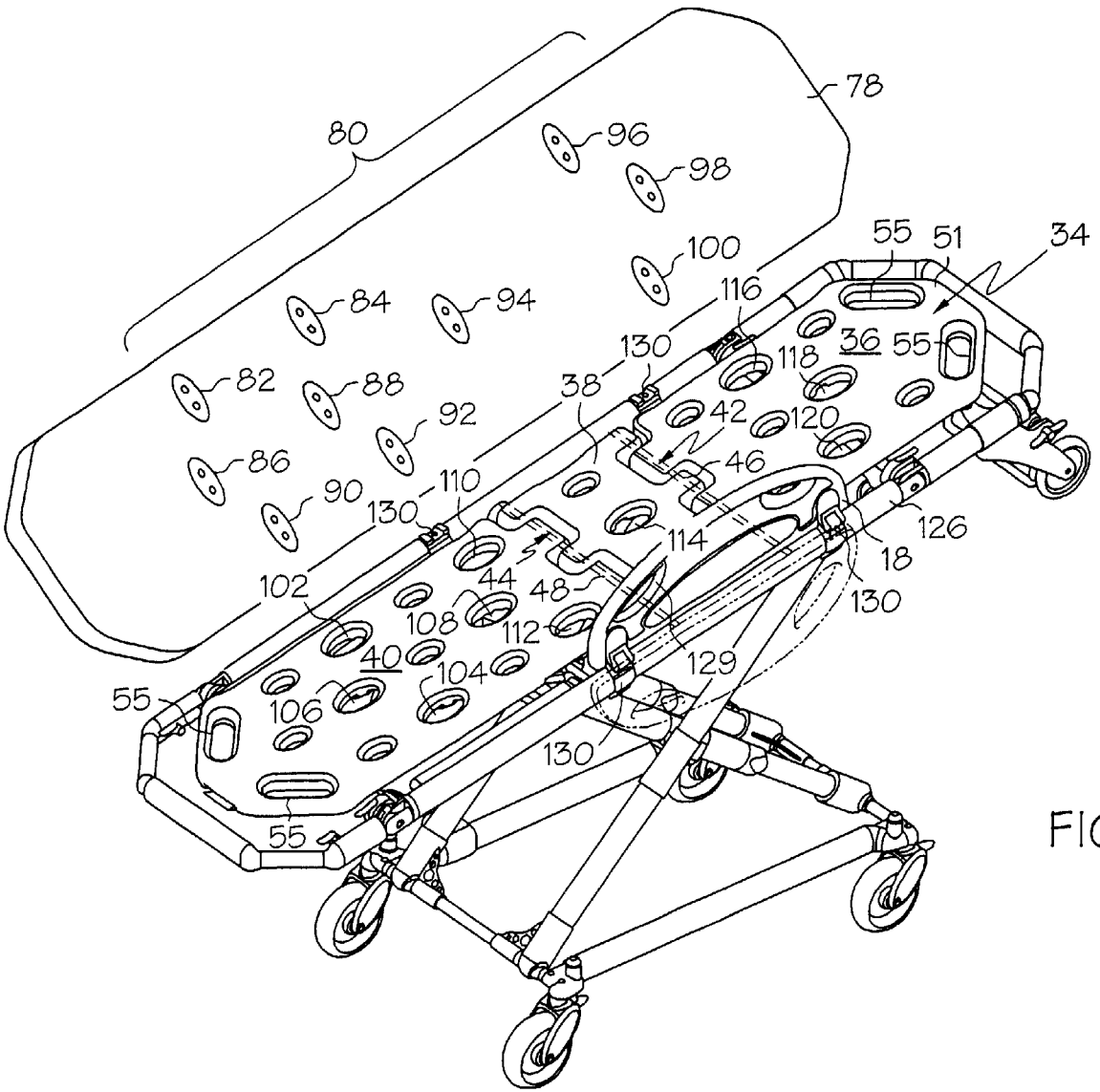
FIG. 2 is a perspective view of the emergency stretcher of FIG. 1, with one of the provided side-arm supports folded completely down.

Referring to FIGS. 1 and 2, illustrated in an elevated position is an emergency stretcher 10, which is designed to be rolled into and fastened to ambulances or other emergency vehicles having different floor heights and fastening systems. The stretcher 10 includes an articulatable patient support 12 used to transport a patient placed thereon, a vertically adjustable undercarriage 14 having a pair of side-arm supports 16, 18 rotatably connected to the undercarriage 14. The undercarriage 14 includes an approximately rectangular support frame 20, a scissor-type lift mechanism 22, and a wheeled base frame 24. Optionally, the support frame 20 may include a foldable handle bar 25 for easier handling and maneuverability. The support frame 20 is height-adjustable relative to the wheeled base frame 24 by the lift mechanism 22 between the shown elevated position and the fully collapsed position of FIG. 12, and a number of relative positions therebetween. To accomplish the lifting, the lift mechanism 22 has its lower ends 26, 28 rotatably connected to the wheeled base frame 24, a first upper end 30 rotatably connected to the support frame 20, and a second upper end 32 rotatably and slidably connected to the support frame 20. Additionally, a securing device 33 is provided internally to the support frame 20 to releasably arrest the vertical movement of the undercarriage securing the support frame at its height-adjusted position. A more specific detailed discussion now follows regarding the construction of the emergency stretcher 10.

The patient support 12 includes a rectangular, longitudinally extending rigid body bed 34 that is articulated in thirds, forming a vertically adjustable back rest portion 36, a seat portion 38, and a vertically adjustable leg support portion 40. As shown in FIG. 2, the seat portion 38 is rotatably connected or hinged to both the back rest portion 36 and leg support portion 40 by a waffle-type engagement or bifurcated hinge end portions 42 and 44. The hinge end portions 42 and 44 are integrally formed in each portion of the rigid body bed 34, and thus, preferably, the rigid body bed is made of a molded thermoplastic construction, but alternatively can be any rigid material, such as aluminum or steel. Accordingly, the hinge end portions 42 and 44 of the rigid body bed 34 are held together by pivot pins 46 and 48, indicated by the dotted lines. It is to be appreciated that the hinge end portions 42 and 44 are orientated so that the patient support 12 may be positioned to provide support and comfort to a patient during transport.

The vertically adjustable back rest portion 36 of the patient support 12, shown in its upright position, is movable to a reclined position as illustrated by the broken lines in FIG. 1. The back rest portion 36 of the patient support 12 is assisted from the reclined position to the upright position, and a plurality of positions therebetween indicated by the arrow line in FIG. 1, by a lifting device 50 attached at an upper end to a back surface 52 of the back rest portion 36. Preferably, the lifting device 50 is a gas-assisted cylinder, or alternatively a hydraulically or mechanically-assisted cylinder. In the preferred embodiment, manipulation of a lever 54, also provided at the upper end of the lifting device, causes the gas-assisted cylinder 50 to raise or lower the back rest portion 36 as desired. That is, depressing or raising the lever 54 operates a detent on the gas-assisted cylinder 50 which releases a locking mechanism internally on the cylinder and permits movement of the back rest portion 36 of the patient support 12. When the lever 54 is released, it moves back to a centered, at rest, position permitting the detent on the to cylinder to rise and lock the back rest portion 36 in place. The lower end of the lifting device 50 is connected to the undercarriage 14 by a rotatable mount 56 (FIG. 6) so that it may rotate downward as it retracts permitting the back rest portion 36 to be placed in the reclined position. As shown in FIG. 2, hand grips 55 are integrally form in both the back rest and leg support portions of the rigid body bed to further assist the technician in the lifting of these portions, and of which a discussion regarding the leg support portion now follows.

Figure 3:
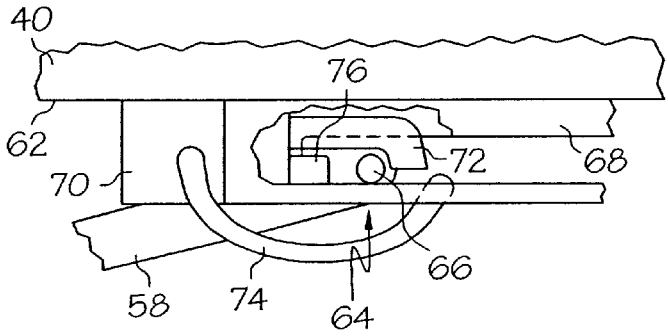
FIG. 3 is a side view of the holding device for the leg support portion of emergency stretcher of the present invention.

The vertically adjustable leg support portion 40 of the patient support 12, shown in a raised position, is movable to a reclined position as illustrated by the broken lines in FIG. 1. The leg support portion 40 of the patient support 12 is maintained at the raised position by a slidable arm 58 rotatably mounted to the undercarriage 14 at a first end 60 (FIG. 6), and slidably mounted to an underside 62 of the leg support portion 40 at a second end 64, best seen in FIG. 3. FIG. 3 shows that the slidable arm 58 at the second end 64 includes a pin 66, wherein the arm moves between a pair of guide slots 68 provided on the underside 62 of the leg support portion 40 to which the pin slides there within.

A holding device 70 locks the pin 66 of the arm 58 in place by a hook 72 when the leg support portion is in the raise position. The holding device 70 is mounted to the underside 62 of the leg support portion adjacent the guide slots 68. As the pin 66 moves towards the holding device 70, from the lifting of the leg support portion 40 by a technician, the pin 66 contacts and pushes downward a lifting bar 74 of the holding device 70. The lifting bar 74 when pushed downward lifts the hook 72, allowing the pin 66 to be passed underneath the hook. After the pin 66 passes over the lifting bar 74, the hook 72 lowers trapping the pin. The pin 66 is released by the holding device 70 by the technician further lifting the leg support portion 40, such that the pin 66 pushes against a release button 76 of the holding device 70. The release button 76 when pressed raises and locks the hook 72 in a raised position allowing the pin 66 to be slid from the holding device 70. As the pin 66 slides over the lifting bar 74 from the technician lowering the leg support portion 40 the hook 72, being spring biased, drops from its raised position to its lowered position, thereby resetting the holding device 70.

Turning back to FIGS. 1 and 2, a cushion 78 may be provided over the rigid body bed 34 to complete the patient support 12. The material of the cushion is conventional in the art, and is sized to properly fit over the rigid body bed 34 and be foldable in thirds with the rigid body bed when affixed thereto. The cushion 78 is releasably connected to the rigid body bed 34 by a button arrangement 80. As shown in FIG. 2, the button arrangement 80 of the cushion includes a plurality of buttons 82–100 positioned in a pattern, wherein the pattern of buttons match a number of through-bores 102–120 provided in the rigid body bed 34 to prevent disassociation therefrom.

Figure 4A:
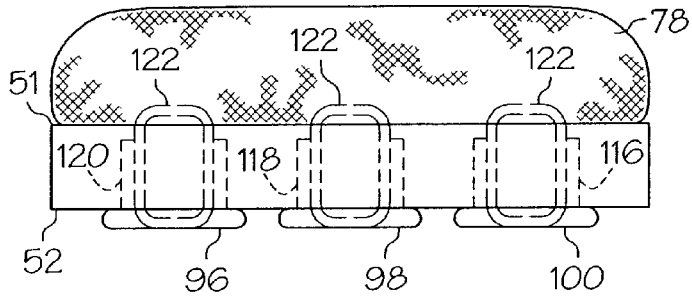
FIGS. 4*a* and 4*b* are bottom and back section views, respectively, of the emergency stretcher of FIG. 1 along section line 4—4, illustrating the manner in which a foldable cushion is releasably connected to a patient support of the emergency stretcher.
Figure 4B:
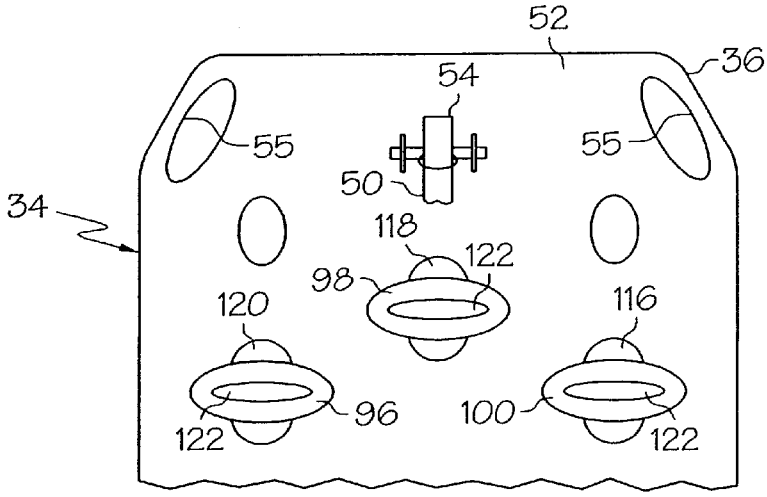

As illustrated by FIGS. 4*a* and 4*b*, showing a section of the cushion along line 4—4 of FIG. 1, each button 82–100 of the button arrangement 80 is elastically fastened with cord 122 to the cushion 78. Each cord 120 of the button is strung internally to the cushion 78 and looped through eyelets of each button 82–100. As shown, each button 82–100 is elliptically or football shaped. The through-bores 102–120 of the rigid body bed 34 are similarly shaped and sized to allow their associated button 82–100 of the cushion to pass through. As shown in FIG. 4*b* the button arrangement 80 is such that each button 96, 98,100 when holding the cushion 78 in place is offset about 90 degree from its similar shaped through-bore 116, 118, and 120, respectively, of the rigid body bed 34. In this manner, the cushion 78 is releasably secured to a front surface 51 of rigid body bed 34 of the patient support 12 by each button 82–100 passing through the through-bores and elastically pressing against the back surface 52 of the rigid body bed 36.

As shown in FIGS. 1 and 2, it is to be appreciated that the pair of side-arm supports 16 and 18 rotate about an axis which is offset from a central axis of opposing, spaced apart first and second longitudinal frame members 124 and 126 of the undercarriage 14, thereby providing 180 degrees rotational freedom of the side-arm supports from a vertically-up position, as illustrated, to a vertically-down position that is indicated by the dotted lines in FIG. 2. A side-arm release 127 is accommodated around the perimeter of one of a pair of through bores 129 of each side-arm support 16 and 18. The side-arm release 127 when squeezed by a technician lifts a pair of spring biased holding pins (not shown) from a pair of recesses 131 (FIG. 5) provided in a respective pair of hinging mounts 130 to which one of the side-arm support 16 or 18 is rotatably mounted to their respective longitudinal frame member 124 or 126.

Figure 5:
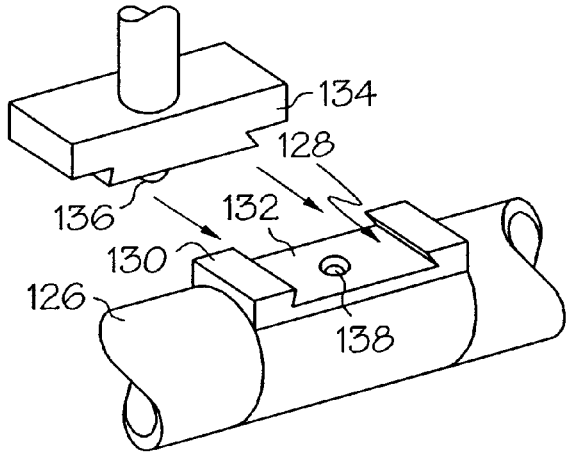
FIG. 5 is a section view of a docking hinge of the present invention adapted to receive an accessory attachment.

When the side-arm support 16 or 18 is in the vertically-down position, a docking port 128 provided with the hinging mount 130 is exposed as illustrated in FIG. 5. It is to be appreciated that the docking port 128 permits various accessories, such as an IV pole to be mounted conveniently and quickly to the stretcher 10. Preferably, the docking port 128 has a dove-tail channel 132 to which an accessory's end having an oppositely shape body attachment 134 may slide in to the channel 132. A detect button or lifting pin 136 provided on the bottom surface of the attachment of the accessory, if so provided, may also engage the one of the pair recesses 138 provided in the center of the channel 132. Additionally, one or both of the recesses 138 of the docking port 128 may also be threaded in order to accept a screw from the attachment 134, if so provided.

Figure 6:
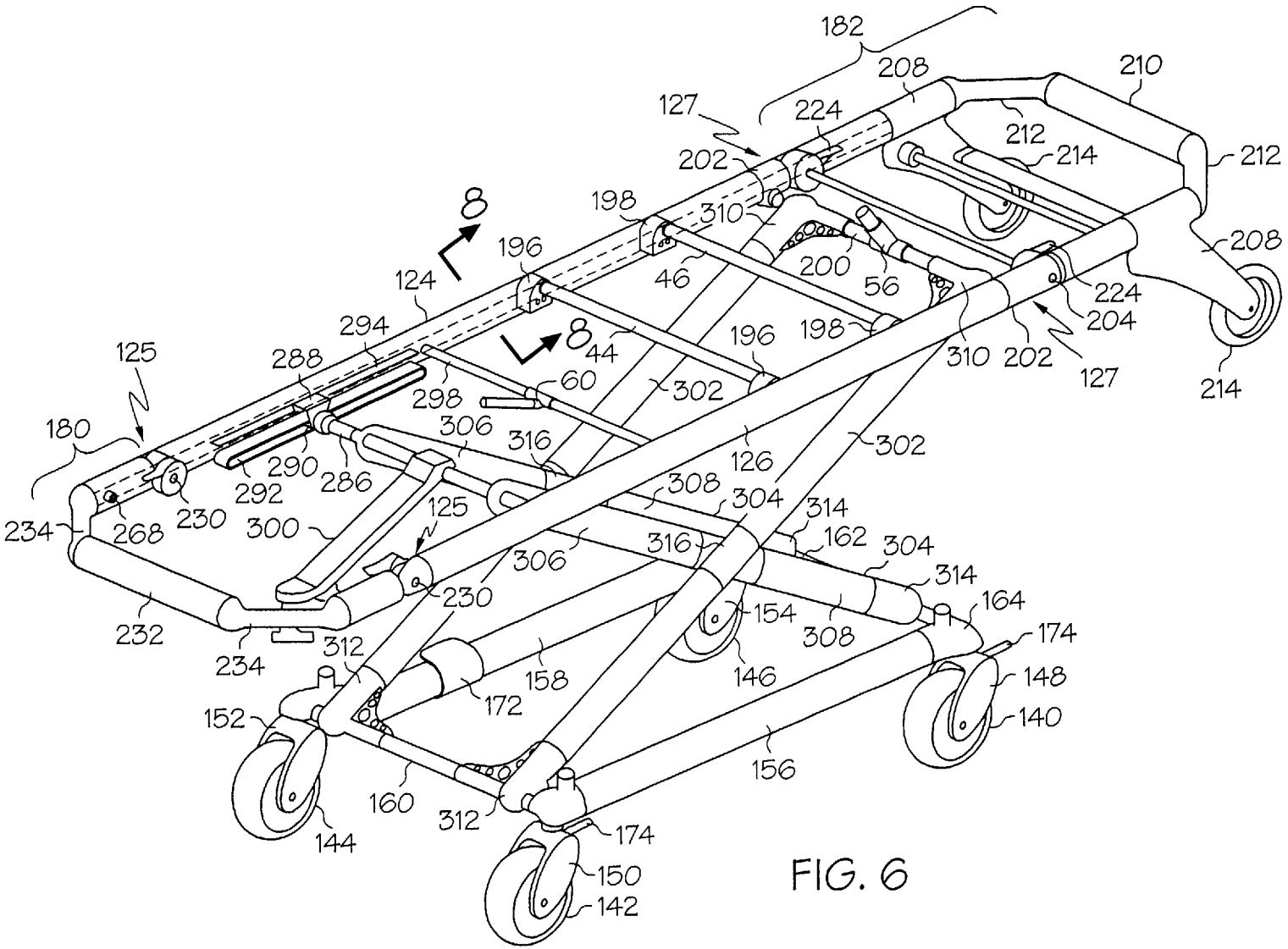
FIG. 6 is a perspective view of the emergency stretcher of FIG. 1, with an articulatable patient support and side-arm supports omitted for purposes of clarity.

FIG. 6 illustrates the rectangular undercarriage 14 of the invention with the patient support 12 removed for convenience of illustration. At the lower end of the undercarriage 14 is the wheeled base frame 24 that is an approximately rectangular frame with four wheels 140–146 located at its corners each by a wheel mount 148–154. The wheeled base frame 24 includes opposing side frame members 156 and 158 interconnected with transverse frame members 160 and 162 by corner mounts 164–170, and includes an attachment 172 which permit the stretcher to be secured within conventional ambulances. Each of the wheel mounts 148 and 150 (same on the opposite side of the stretcher) has a foot brake mounted rotatably mounted to the wheel mount 148–154 and which arrests the movement of the associated wheel when depressed.

Figure 7:
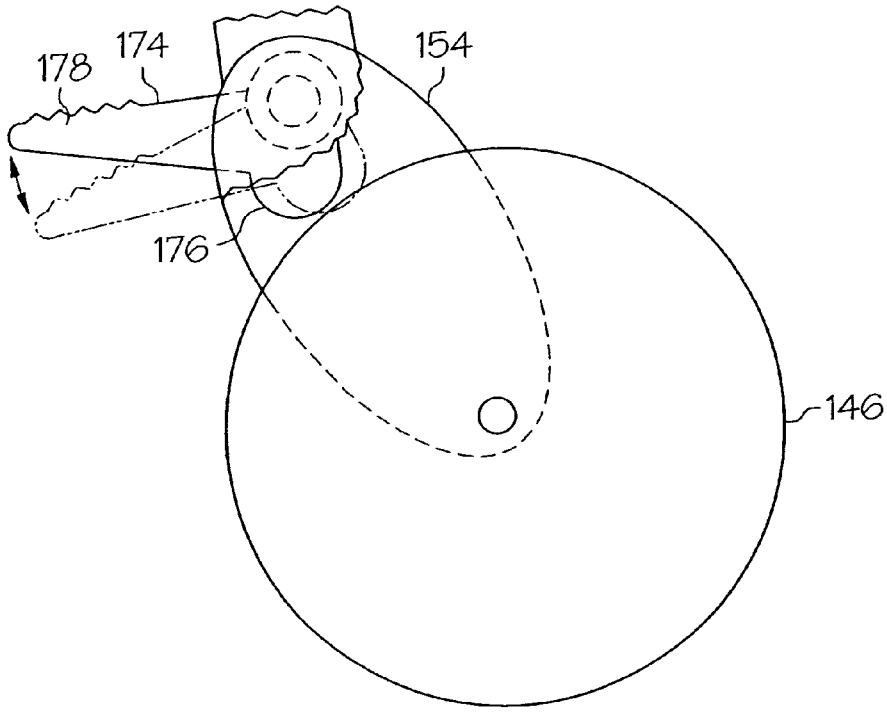
FIG. 7 is a close-up side view of a wheel brake used with the emergency stretcher of the present invention.

FIG. 7 shows a cut-away view of the wheel brake 174 along line 7—7 of FIG. 1 being rotatably mounted to the wheel mount 154 offset from the rotational axis of the wheel 146 and slight above the top surface of the wheel. It is to be appreciated that the wheel brake having a nose portion 176 at the end of a level arm portion 178 provides the nose portion with a large mechanical advantage with only a small downward movement of the lever arm portion, indicated by the arrows, thereby providing a feather touch to the braking and braking release of the associated wheel 146.

Turning back to FIG. 6, at the upper end of the undercarriage 14 is the support frame 20 which includes the first and second longitudinal frame members 124 and 126, with proximate and distal ends, indicated generally by 125 and 127, respectively, a first movable end extension indicate generally by 180, rotatably connected at the proximate ends 125 of said longitudinal frame members 124 and 126, and a second movable end extension, indicated generally by 182, rotatably connected to said distal ends 127 of said longitudinal frame members 124 and 126. It is to be appreciated that both the longitudinal frame members 124 and 126, framing members 156, 158, 206, 210, 228, and 232, and fixed length leg members 302, which form part of the movable end extensions and wheeled base, both discussed more specifically hereafter, are tubular and preferably, an elliptical tube of composite material, but alternatively can be plastic, aluminum or steel, or a combination thereof.

Figure 8:
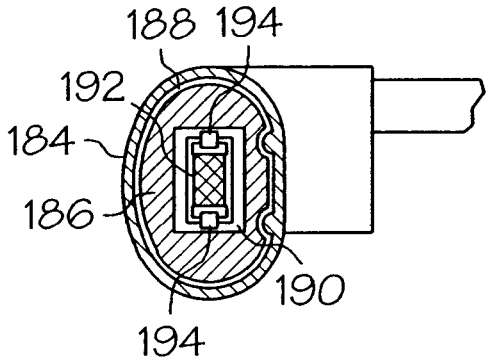
FIG. 8 is a section view of the emergency stretcher of FIG. 6 along section line 8—8, illustrating the construction of a frame member of the present invention.

More specifically, as illustrated in FIG. 8, which shows a cross-section of the first longitudinal frame member 124 along line 8—8 of FIG. 6, all other framing members provided on the stretcher is similar in construction and dimensions to an outer-tubular layer 184 of the longitudinal frame member 124, in order to minimize manufacturing costs. Since the securing device 33 is accommodated within an interior cavity 188 the longitudinal frame member 124, the outer-tubular layer of the frame members is a tube having an inside cross section based on an ellipse with a major axis of about 2 to 2.5 inches, preferably 2.1 inches, and a minor axis of 1.25 to 1.5 inches, preferably 1.435 inches. The shape of the outer-tubular layer 184 is preferably formed from a pultruded profile. To further add to the overall strength of the undercarriage 14, an insert 186 is accommodated within the interior cavity 188 of the outer-tubular layer 184.

The insert 186 is preferably oppositely shaped to the interior surface of the outer-tubular layer 184, having a slightly smaller diameter, to provide a tight fit therewithin. The insert 186 is preferably aluminum, but alternatively can be a high-density plastic, laminate, or metal. It is further to be appreciated that the combination of the outer-tubular layer 184 and insert 186 function together to provide an extremely light but sturdy framing member. Additionally, the insert 186 improves the wear resistance of the outer-tubular layer 184 from the securing device 33 sliding/rolling within the longitudinal members 124 and 126. This is accomplished by providing inside the insert 186 a rectangular cavity 190. The rectangular cavity 190 of each insert 186 slidably houses an elongated securing bar 192 having a set of rollers 194. Each securing bar 192, thus internal to the longitudinal members 124 and 126, forms part of the securing device 33. A more detailed discussion concerning the securing device 33 and its operation will follow after completing the discussion on the components which comprise the support frame 20 of the undercarriage 14.

In a middle portion of the support frame 20 shown by FIG. 6 provided is the pair of pivot pins 46 and 48 to which the patient support 12 is held together at its hinge end portions 42 and 44, respectively. Each of the pivot pins 46, 48 is mounted at their ends to the support frame 20 by two pairs of seat support brackets 196 and 198 that are conventionally attached to the longitudinal frame members 124 and 126. To a first crossbar 200, which is adjacent the second movable end extension 182 and centrally provided thereon, provided is the rotatable mount 56 that connects the lower end of the lifting device 50, which is shown in fragmented view. The first crossbar 200 is mounted at each of its ends to the longitudinal frame members 124 and 126 of the undercarriage 14 by a pair of support brackets 202 that are integral with a pair of rotatable locking hinges 204, see also FIG. 1 for the other side. The rotatable locking hinges 204 are connected to the distal ends of the longitudinal frame members 124 and 126. The rotatable locking hinges 204 serve to rotatably mount the second movable end extension 182 thereon.

Figure 9:
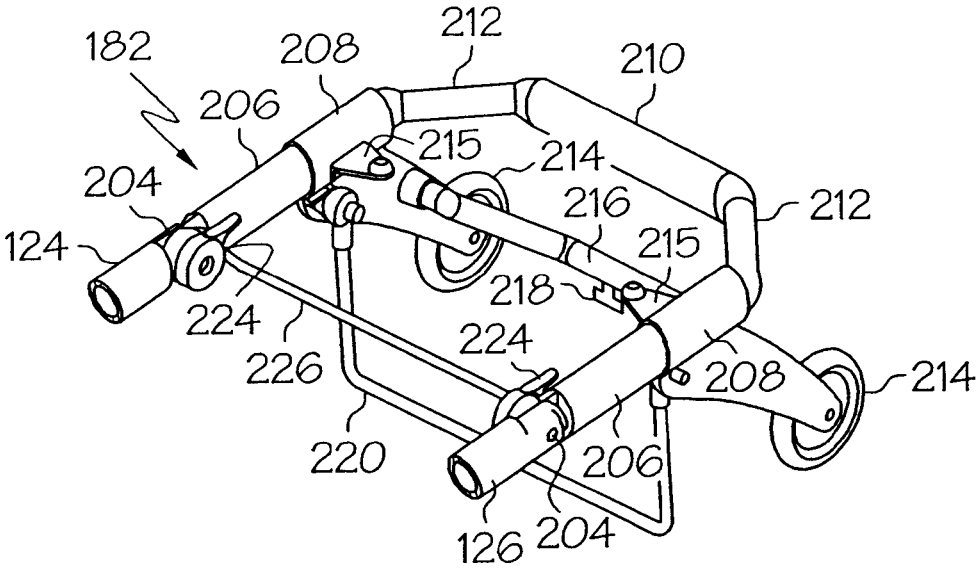
FIG. 9 is a perspective view of a second movable end extension of the emergency stretcher of the present invention.

As shown by FIG. 9, the second movable end extension 182 has a pair of tubular side frame members 206 joined at their first ends by the pair of rotatable locking hinges 204. The side frame members 206 at second ends are connected to a pair of wheel mounts 208, which in turn connect to each other via a tubular end frame member 210. The end frame member 210 includes spaced apart handgrips 212 that are shaped to be gripped conveniently by a technician's hand. The second movable end extension 182 is provided with a pair of loading wheels 214 projecting downwardly from the pair of wheel mounts 208. A pair of rest stops 215, which support the back-rest portion 36 of the patient support 34, extend horizontally from the pair of wheel mounts 208. Further, the wheel mounts 208 are interconnected by a convexly-shaped rod 216 supporting a safety hook 218, and a generally U-shaped tubular bail 220 which is spring biased to an anchoring position which extends downwardly between said wheel mounts 208. The bail 220 is movable from the anchoring position to an elevated release position, which permits the attendant to release the safety hook 218 from an engagement with a compatible floor fitting of an ambulance, if so provided. Further, bolting brackets 222 (FIG. 1) are mounted to the first crossbar 200. Accordingly, the safety hook 218 and bail 220, and the pair of bolting brackets 22 are provided to interface with one of the conventional fittings that may be mounted within the emergency vehicle to safely secure the stretcher when placed in the emergency vehicle, making the stretcher 10 compatible with number of an ambulance fastening system currently in use.

As illustrated in FIG. 1, the second movable end extension 182 may be rotatably adjusted to a planar position 181, to a beveled position 183, and to a dropped position 185 by a pair of release levers 224, as illustrated by FIG. 1 with the latter two positions being indicated by the dashed lines. As shown best in FIG. 9, the pair of release levers 224 are mounted inboard of the rotatable locking hinges 204 and interconnected by a release bar 226 which permits a technician to rotate the second movable end extension 182 to one of these positions by one finger operating either release levers or the release bar. It is to be appreciated that the dropped position (FIG. 1) places the second movable end extension about perpendicular to the wheeled base frame 24, which permits the stretcher 10 to be moved in tight spaces. Further, it is to be appreciated that the bevel position 183 permits a technician to better grasp the stretcher 10 when lifting in certain situations, e.g., down stairs. Accordingly, the release levers 224 operate a locking arrangement that is provided internally to each of the rotatable locking hinges 204, and of which a more detailed discussion on the locking arrangement will be provided with regards to the first movable end extension 180. When the technician releases the levers 224 the second movable end extension is locked in the desired position by the rotatable locking hinges 204.

Figure 10:
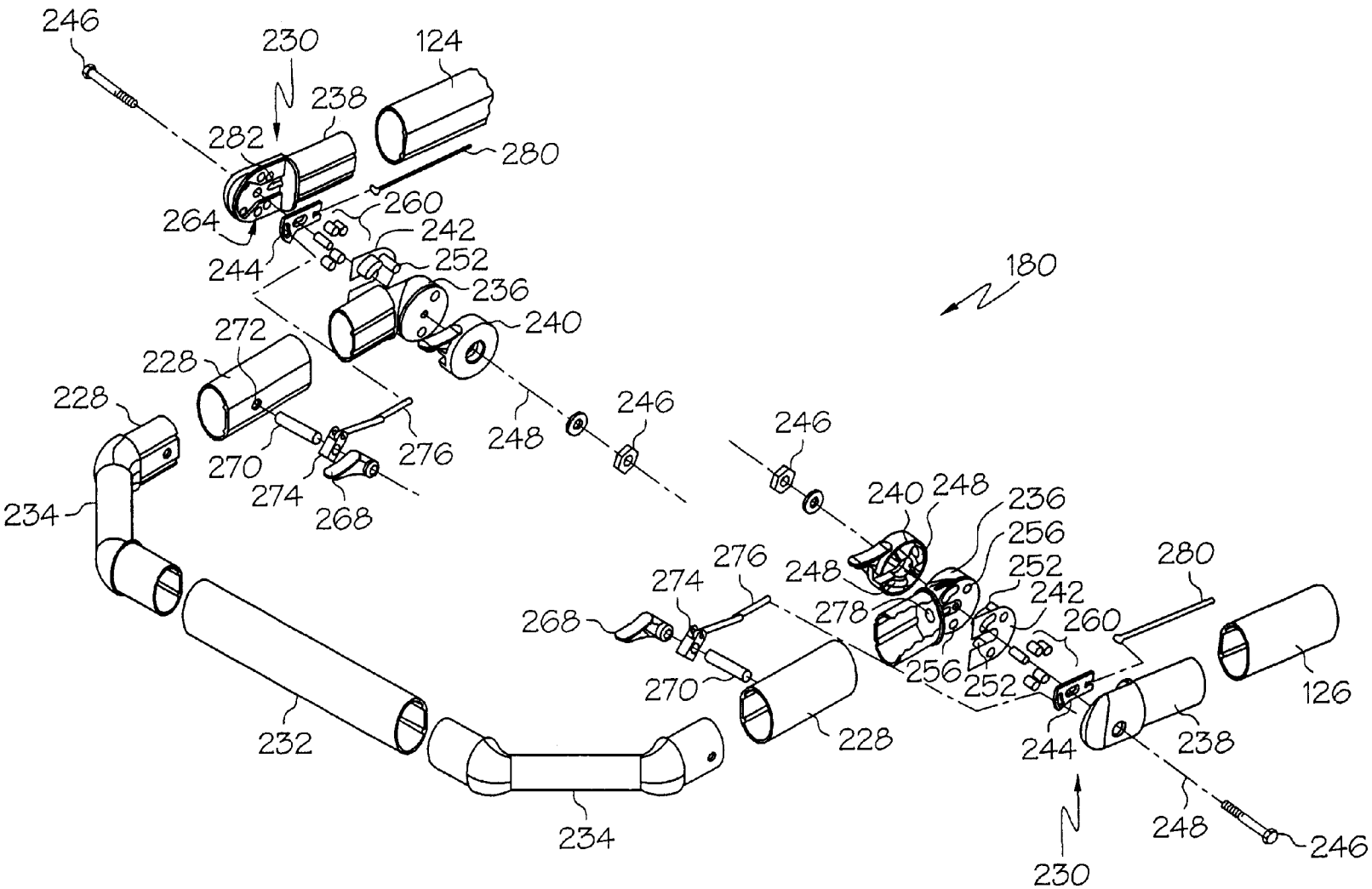
FIG. 10 is an exploded view of a first movable end extension of the emergency stretcher of the present invention.

As illustrate in exploded view by FIG. 10, the first movable end extension 180 has a pair of tubular side frame members 228 joined at first ends to a second tubular end frame member 232, via a pair of spaced apart handgrips 234. The handgrips 234 are shaped to be gripped conveniently by a technician's hand. The side frame members 228 at second ends are rotatably connected by another pair of rotatable locking hinges, generally indicated by 230. The rotatable locking hinges 230 are connected to the proximate ends 125 of the longitudinal frame members 124 and 126, and are similar in design and operation as the pair of rotatable locking hinges 204 at the distal end of the longitudinal members. More specifically, the side frame members 228 are interconnected to a pair of first intermediate member 236 of the locking hinges 230 by a tube and butt arrangement, as well as the longitudinal frame members 124 and 126 each to one of a pair second intermediate member 238 of the locking hinges 230. It is to be appreciated that wherever a frame member connects with a respective mount it may also be by a tube and butt arrangement.

Further, as with the second movable end extension 182, another pair of release levers 240 are provided one of each on the outer facing surface of the first intermediate member 236 of the locking hinges 230, thereby facing each other across the second movable end extension. Mounting the two pairs of release levers 224 and 240 in this manner provides for easy thumb activation by a technician and further provides the support frame 20 with a clean outwardly facing side surface, thereby minimizing the surfaces to which obstructions may catch or strike. A technician desiring to reposition the first movable end extension 180 must depress both release levers 240 in order to release the internal locking components of each rotatable locking hinge 230. For convenience, a discussion will now be provided in reference to only one rotatable locking hinge as the others locking hinges are constructed and operated in essentially the same fashion.

Between the first and second hinge members 236 and 238, respectively, forming the internal locking components of each of the locking hinges, provided and housed therebetween are a push plate 242 and a sliding pull plate 244. These locking components are held together by a bolt and nut arrangement 246 that is accommodated to pass centrally through each component, indicated by the dotted line 248. To move the push plate 242, the release lever 240 on an interior surface is formed with a pair of sloping ramps 248 which are in an abutting relationship with a pair of posts 252 provided on the push plate. The posts 252 of the push plate 242 are size to extend through a pair of through-bores 256 provided in the first hinge member 236, such that when the release lever 240 is depressed the posts 252 are moved by sliding up the ramps 248 of the release lever.

The movement of the push plate 242, via the posts being ramped up, unseats a set of pins 260 from nesting holes 264 provided in the second hinge member 238. Since the set of pins 260 are spring biased, when the release lever 240 is no longer depressed, the pins will spring into an associated nesting hole when properly positioned. It is to be appreciated that the arrangement of the nesting holes 264 on the second hinge member 238 provide for the positions that are available to the first and second movable end extensions 180 and 182. As such, the nesting holes 264 are arranged to permit the first movable end extension 180, as well as the second end extension 182, to be rotatably adjustable between the planar position 181, the beveled position 183, and the dropped position 185 by the pair of release levers, as illustrated by FIG. 1, with the latter two positions being indicated by the dashed lines. It is to be appreciated that stops are provided in each of the rotatable locking hinges to prevent over positioning of either of the two movable end extensions. Further it is to be appreciated that the bevel position 183 permits a technician to more easily lift the stretcher 10 into an emergency vehicle with a high loading floor than if in the planar position 181. Preferably, the bevel position 183 drops the movable end section 180 or 182 about 30 degrees from its planar position 181.

Further illustrated by FIG. 10, provided on the first movable end extension 180 is a pair of release flippers 268 that are operationally connected to the securing device 33, such that depressing one of the pair of release flippers releases the securing device permitting vertical movement of the patient support 34 by the undercarriage 14. Further, it is to be appreciated that the release flippers will release the securing device in any of the position of the first end extension. The release flippers 268 are rotatably mounted to the inner facing surface the first movable end extension each by a pin 270. Additionally, the pair of release flippers 268 are situated adjacent and forward of the pair of hand grips 234 to permit operation by the thumbs of a technician when gripping either hand grip. Each pin 270 of the pair of release flippers 268 extends into a hole 272 provided in its respective side framing member 228, and mounted there by a mounted cam 274. The cam 274 is further rotatably connected to a linkage 276, which is in turn rotatably connected to the sliding pull plate 244 through an opening 278 centrally provided on the interior base surface of the first hinge member 236. The sliding pull plate 244 on each side of the first end extension is in turn connected to a release arm 280 which extends through an opening 282 provided in a base surface of the second hinge member 238 to an associated latch 284 (FIG. 11) of the securing device 33, and of which a detailed discussion is now provided.

Figure 11:
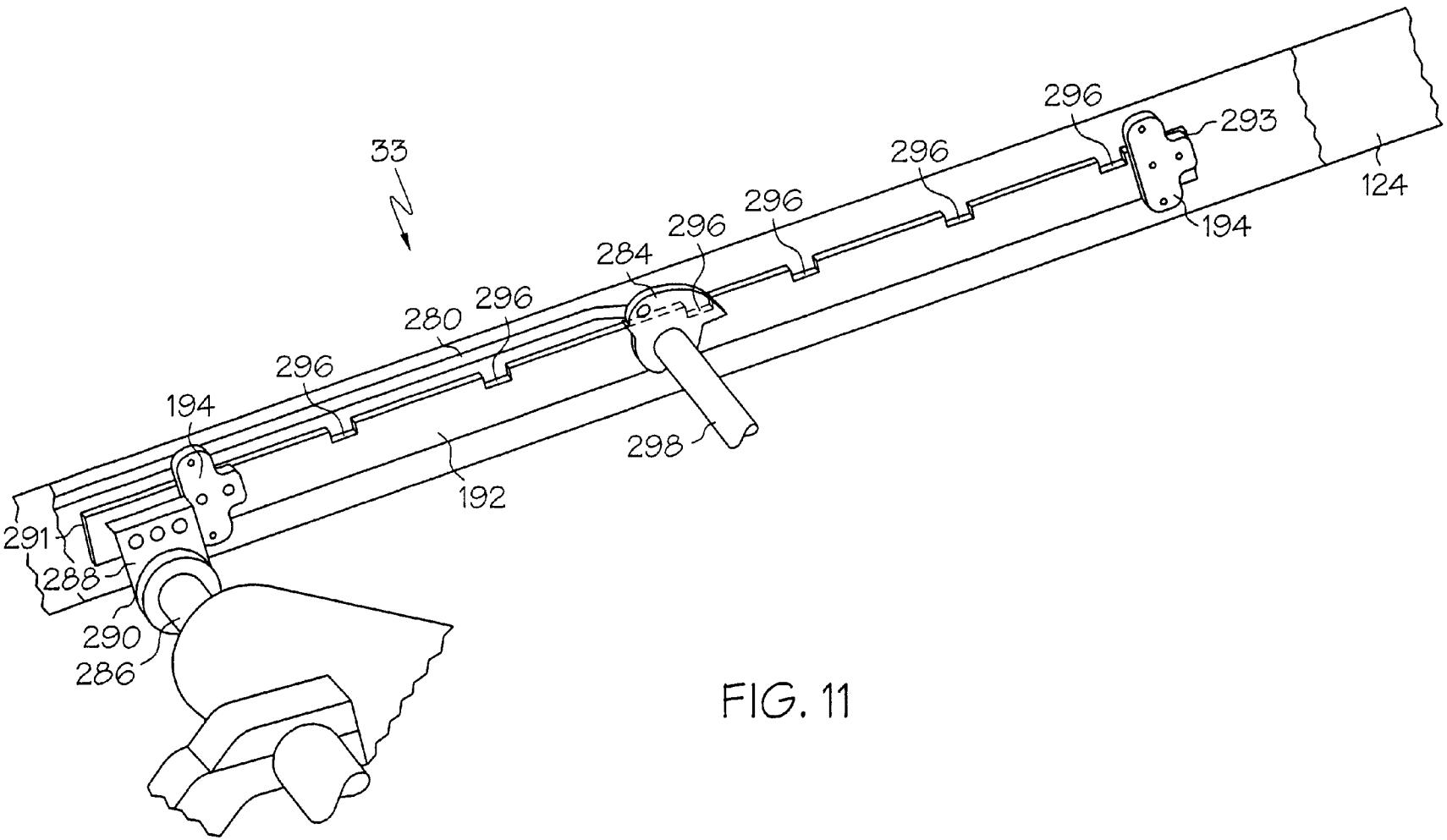
FIG. 11 is a perspective fragmented view of a longitudinal frame member of the emergency stretcher of the present invention, partially cut-away showing a securing device of the present invention.

FIG. 11 is a fragmented view of the first longitudinal frame member 124, partially cut away, showing that internally housed is a first side of the securing device 33. A second side of the securing device 33 is shown internal to the longitudinal frame member 126 in FIG. 1. For convenience of illustration, however, only the first longitudinal frame members 124 and the components of the first side of the locking device 33 will be discussed as the corresponding structure on the opposite side of stretcher is the same. With reference made also to FIG. 6, shown is a second crossbar 286 that is slidably connected at its ends to the longitudinal frame members 124 and 126 by a pair of mounting brackets 288. Each of the mounting brackets 288 includes a roller 290 which rolls in one of a pair of track 292 mounted below a slot 294 provided in the inner facing side of each longitudinal frame member 124. Each pair of mounting brackets 288 attaches adjacent a first end 291 of its respective securing bar 192 through the provided slot 294. It is to be appreciated that the roller 290 of each mounting bracket 288 assists in the sliding action of the second crossbar 286 by carrying the weight/load of the support frame 20 upon the guide tracks 292 of the longitudinal frame members 124 and 126.

Each securing bar 192 includes a plurality of spaced apart notches 296 spaced there along which are selectively engaged by its associated latch 284 to prevent the movement of the second crossbar 286, thereby releasably arresting the vertical movement of the undercarriage 14. The pair of latches 284 when positioned in one of the notches 296 of their associated securing bar 192 secures the stretcher at that predetermined height which corresponds to the recesses location along the securing bar 192. Preferably, one of the notches 296 closest to the first end 291 of the securing bar 192 secures the stretcher 10 in its fully elevated position (FIG. 1), and one of the notches 296 closest to a second end 293 of the securing bar 192 secures the stretcher at its fully collapsed position of FIG. 12.

The notches 296 of the securing bar 192 are shaped to permit the support frame 20 to be vertically adjusted by a technician lifting upon the support frame by the either pair of hand grips 234 or 212. Lifting the support frame 20 pushes the securing track towards the distal end 127 of the longitudinal members 124 and 126, which unseats the latches 284 of the securing device 33 from the recesses of the securing bar. At the desired vertical height, the latches 284, with their pointed nose shape, will engage firmly in the oppositely shaped notches 296 of their associated securing bar 192. It is to be appreciated that the latches 284 stay firmly rooted in the accommodating notches 296 since they are spring biased towards the securing bar 192. Additionally, the pair of latches 284 are interconnected by a cross rod 298. Having the pair of latches 284 interconnected permits the disengaging each of the pair of latches 284 from its associated notches of the securing bar 192 in unison.

The set of rollers 194 are mounted at or near the first and second ends 291 and 293 of the securing bar 192. Mounting the set of roller in this manner permits the rolling of the securing bars along the interiors of the longitudinal frame member 124 and 126 when the pair of latches 284 are lifted out of their accommodating notches. The pair of latches are lifted out of their accommodating notches by the pull of the pair of releasing arms 280 from a technician depressing either one or both of the pair of release flippers 268 provided on the first movable end extension 180, thereby permitting the stretcher 10 to be vertically adjusted downward or upward.

As shown in FIG. 6, the second cross bar 286 also supports an additional safety hook 300 that is compatible with an anchoring system, such as the type disclosed by U.S. Pat. No. 5,913,559 to Sexton et al., and of which is incorporated by reference. It is to be appreciated that the leg attachment 172, the safety hooks 218 and 300, the bail 220, and the pair of bolting brackets 222 together are anchor attachments that makes the stretcher 10 compatible with a majority of ambulance securing devices currently in use. As such, the stretcher 10 is ensured provided an anchoring attachment that is releasably engageable with at least one complementary stretcher anchoring system mounted on the floor of the emergency vehicle.

Additionally shown in FIG. 6 is the lift mechanism 22 which includes a pair of fixed-length leg members 302 and a pair of telescoping variable-length leg members 304. The pair of telescoping variable-length leg members each has an extensible member 306 and a cylinder member 308. The variable-length leg members 304 may include gas-charged cylinders therein to assist in extending the lift mechanism 22 and in raising the stretcher 10 thereby. At their uppermost ends, the cylinder member 308 of each variable-length member 304 is rotatably connected to the second crossbar 286, and the fixed-length leg members 302 are rotatably connected to the first crossbar 200 by a pair of L-shaped crossbar fittings 310. At their lowermost ends both pairs of leg members 302 and 304 are rotatably connected to a respective transverse frame member 160 and 162, respectively, of the wheeled base by additional pairs of L-shaped fittings 312 and 314.

Figure 12:
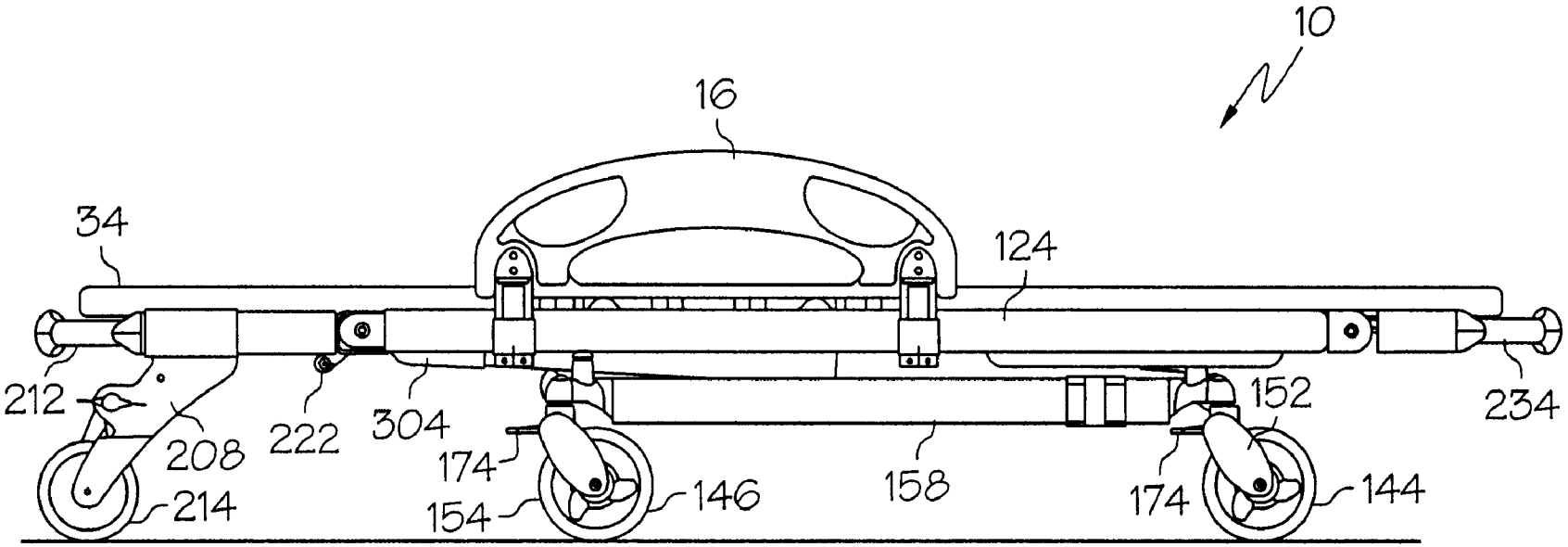
FIG. 12 is a side view of the stretcher of FIG. 1, in a different operational position.

Each fixed-length leg member 302 is connected to one of the pair of variable-leg members 306 at their respective mid-sections by a rotatable joint 316, and are rotatable with respect to one another along an axis of the joint. It is to be appreciated that do to the diameter of the leg members and the with the interconnection of the leg members with rotatable joint 316, sway bars are not need to steady the legs members. With the arrangement just described, the support frame may be collapsed against the wheeled based as shown in FIG. 12 with a one-hand operation by depressing one of release flippers 268 (FIG. 10) to release the pair of latches 284 from their associated securing bar 192 (FIG. 9) and permitting the second cross bar 286 to move to the outermost ends of the guide tracks 292 provided along the longitudinal frame members 124 and 126, coupled with the telescoping of the extensible members 308 of the telescoping legs 304 within lowermost ends of cylinder members 306.

As the stretcher 10 is elevated, the sets of leg members 302 and 304 will elevate the patient support 12 relative to the undercarriage 14 in a generally horizontal plane. However, as the fully elevated positions of the patient support 12 is approached, i.e., such as the two innermost recesses on the pair of securing bars 192, the patient support 12 will be inclined upwardly at the second movable end extension 182, as illustrated in FIG. 1. The upward positioning of the second movable end extension occurs by reason of the telescoping of the variable-length leg members 304 being shorter than the fixed-length leg members 302 and the attachment points of intersection of these pairs of leg members by the pair of joints 316. Accordingly, elevating the loading wheels to a higher position than if the patient support remained horizontal, permits the transfer of the stretcher into an emergency vehicle having an unusually high floor level.

Having described the invention in detail and by reference to preferred embodiments thereof, it will be apparent that modifications and variations are possible without departing from the scope of the invention defined in the appended claims.

What is claimed is:

1. An emergency stretcher, comprising:

an undercarriage having a wheeled base and a pair of elongated tubular frame members providing at least one cavity, said tubular frame members being vertically adjustable relative to said wheeled base;

an articulatable patient support mounted between said tubular frame members;

a securing device substantially accommodated within said cavity and adapted to releasably arrest vertical movement of said undercarriage; and a securing bar accommodated within said at least one cavity and having a plurality of spaced apart notches, said securing device includes a latch for selectively engaging said notches.

2. The emergency stretcher of claim 1, wherein said undercarriage further includes a scissor-type lift mechanism operably mounted between said tubular frame members and said wheeled base, said lift mechanism is adapted to adjust the vertical height of the undercarriage between an elevated position, a collapsed position, and a number of relative positions therebetween.

3. The emergency stretcher of claim 1, wherein said tubular frame members have first and second ends, and said undercarriage includes first and second movable end extensions rotatably mounted to said first and second ends, respectively.

4. The emergency stretcher of claim 1 wherein said tubular frame members provide two cavities each being accessible by a respective one of a pair of slots, said undercarriage further comprising a first crossbar mounted between said tubular frame members, and a second cross bar slidably mounted in said cavities through said slot, said stretcher includes a pair of fixed-length leg members and a pair of telescoping variable-length leg members, said fixed length leg members at uppermost ends thereof are rotatably connected to said first crossbar, and said variable-length members at uppermost ends thereof are rotatably connected to said second crossbar, and wherein said leg members at lowermost ends thereof are rotatably connected to said wheeled base.

5. The emergency stretcher of claim 1, further comprising at least one actuator operationally connected to said securing device and mounted to an adjustable end extension mounted between said frame members, said at least one actuator is adapted to permit said vertical movement of said undercarriage when operated.

6. An emergency stretcher, comprising:

a patient support; and a vertically adjustable wheeled undercarriage supporting said patient support, said undercarriage having opposed first and second longitudinal frame members, and first and second movable end extensions interconnecting said longitudinal frame members, said end extensions are rotatably mounted to said undercarriage and each is adapted to be releasably secured in at least one of a plurality of positions from about parallel to said longitudinal frame members and to about perpendicular to and below said longitudinal frame members.

7. The emergency stretcher of claim 6, wherein said undercarriage further comprises a pair of side-arm supports pivotably connected to respective ones of said tubular frame members.

8. The emergency stretcher of claim 6, wherein said patient support includes a vertically adjustable back-rest portion, a seat portion having a first and second ends, and a vertically adjustable leg support portion, wherein said back-rest portion is hinged to said first end of said seat portion, and said leg support is hinged to said second end of said seat portion.

9. The emergency stretcher of claim 8, wherein said vertically adjustable back-rest portion is positionable between an upright position and a reclined position and a number of positions therebetween by a lifting device having upper and lower ends, said upper end of said lifting device attached to said back rest portion, and said lower end of the lifting device is rotatably mounted to said undercarriage.

10. The emergency stretcher of claim 8, wherein said undercarriage further comprises a holding device and a slidable arm adapted to vertically adjust said leg support portion between elevated and reclined positions.

11. The emergency stretcher of claim 8, wherein said back rest portion has an integrally formed hinged end, said ends of said seat portion are integral formed hinged ends, and said leg support portion has an integrally formed hinged end, wherein said hinged ends form a waffle-type engagement.

12. The emergency stretcher of claim 6, comprising a cushion having a plurality of buttons provided in a button arrangement, wherein said patient support has a front surface, a back surface, and a plurality of through-bores, wherein said cushion is releasably secured to said front surface of said patient support by said plurality of buttons passing through said through-bores of said patient to engage said back surface of said patient support.

13. The emergency stretcher of claim 6 wherein said patient support includes a seat portion and a pair of pins, wherein said seat portion is mounted between said tubular frame members by said pair of pins, and said tubular frame members have first and second ends, and said undercarriage includes first and second movable end extensions rotatably mounted to said first and second ends.

14. The emergency stretcher of claim 6 wherein said undercarriage comprises a wheeled base having four wheels each including a wheel brake.

15. The emergency stretcher of claim 6, wherein each of said end extensions is movable to a planar position, to a beveled position, and to position about perpendicular to and below said tubular frame members.

16. The emergency stretcher of claim 6, further comprising a pair of side arm supports, each one of said side arm supports are mounted to a respective one of said longitudinal frame members, and each said side-arm supports has a docking port for accessory attachment.

17. The emergency stretcher of claim 6 further comprising a securing device adapted to releasably arrest vertical movement of said patient support by said undercarriage.

18. The emergency stretcher of claim 6, wherein said undercarriage further includes a wheeled base and a scissor-type lift mechanism operably mounted between said tubular frame members and said wheeled base, said lift mechanism is adapted to adjust the vertical height of the undercarriage between an elevated position, a collapsed position, and a number of relative positions therebetween.

19. The emergency stretcher of claim 6, further comprising a securing device accommodated within a cavity of said first longitudinal frame member for arresting said vertical movement of said undercarriage.

20. The emergency stretcher of claim 19 wherein said securing device comprises a bar with a plurality of spaced apart notches and a latch for selectively engaging said notches.

* * * * *